US008661721B2

(12) United States Patent
Hess et al.

(10) Patent No.: US 8,661,721 B2
(45) **Date of Patent: *Mar. 4, 2014**

(54) FLAME SIMULATING ASSEMBLY

(76) Inventors: Kristoffer Hess, Cambridge (CA); Kelly Stinson, Kitchener (CA)

( * ) Notice: Subject to any disclaimer, the term of this patent is extended or adjusted under 35 U.S.C. 154(b) by 1616 days.

This patent is subject to a terminal disclaimer.

(21) Appl. No.: 11/198,347

(22) Filed: Aug. 8, 2005

(65) Prior Publication Data

US 2006/0026894 A1 Feb. 9, 2006

Related U.S. Application Data

(63) Continuation of application No. 09/968,796, filed on Oct. 3, 2001, now abandoned.

(30) Foreign Application Priority Data

Sep. 12, 2001 (CA) ..... 2357182

(51) Int. Cl.
*G09F 19/00* (2006.01)
*A63J 5/02* (2006.01)

(52) U.S. Cl.
USPC ..... 40/428; 472/65

(58) Field of Classification Search
USPC ..... 40/428; 472/65
See application file for complete search history.

(56) References Cited

U.S. PATENT DOCUMENTS 1,514,552 A 11/1924 McCormick
1,531,171 A 3/1925 Berry et al.
1,703,761 A 2/1929 Berry
1,719,622 A 7/1929 Price
1,768,284 A 6/1930 Berry
1,809,164 A 6/1931 Grin
1,824,388 A 9/1931 Birch
1,827,941 A 10/1931 Gross
1,843,279 A 2/1932 Gritt
1,867,740 A 7/1932 Guy
1,901,294 A 3/1933 Gritt et al.
1,974,068 A 9/1934 Greensaft
2,285,535 A 6/1942 Schlett
2,286,246 A 6/1942 Yearta
2,708,114 A * 5/1955 Hancock ..... 40/428
2,963,807 A 12/1960 Relph et al.
3,119,371 A 1/1964 Zuckerman
3,395,475 A 8/1968 Moss
3,395,476 A 8/1968 Moss et al.
3,445,948 A 5/1969 Moss et al.
3,582,961 A 6/1971 Shindo
3,603,013 A 9/1971 Reed et al.
3,694,945 A 10/1972 Detiker (Continued)

FOREIGN PATENT DOCUMENTS

CA 2357182 1/2009
CN 1464961 3/2006

(Continued)

*Primary Examiner* — Syed A Islam

(57) ABSTRACT

The invention provides a flame simulating assembly having a simulated fuel bed, a light source, and a screen. The light source is operable to produce an image of flames appearing to be emitted from the simulated fuel bed. The screen has a front surface disposed behind the simulated fuel bed for transmitting the image of flames through the front surface. A pattern is included in the screen for simulating the appearance of firebrick to a viewer of the image of flames.

11 Claims, 4 Drawing Sheets

(56) References Cited

U.S. PATENT DOCUMENTS

| | | | | |
|---|---|---|---|---|
| 3,730,138 | A | 5/1973 | Suchowski | |
| 3,978,598 | A | 9/1976 | Rose et al. | |
| 4,296,154 | A | 10/1981 | Ibberson | |
| 4,321,778 | A | 3/1982 | Whitehead | |
| 4,557,954 | A | 12/1985 | Gundlach et al. | |
| 4,659,111 | A | 4/1987 | Credit | |
| 4,673,609 | A | 6/1987 | Hill | |
| 4,925,705 | A | 5/1990 | Hill | |
| 4,927,238 | A | 5/1990 | Green et al. | |
| 4,965,707 | A | 10/1990 | Butterfield | |
| 5,090,357 | A | 2/1992 | Pucci | |
| 5,195,820 | A | 3/1993 | Rehberg | |
| 5,265,360 | A | 11/1993 | Reiss et al. | |
| 5,291,297 | A | 3/1994 | Steinmeyer | |
| 5,500,765 | A | 3/1996 | Eichenlaub | |
| 5,525,177 | A | 6/1996 | Ross | |
| 5,642,580 | A | 7/1997 | Hess et al. | |
| 5,743,038 | A | 4/1998 | Soto | |
| 5,787,618 | A | 8/1998 | Mullis | |
| 5,823,784 | A | 10/1998 | Lane | |
| 6,047,489 | A | 4/2000 | Hess et al. | |
| 6,050,011 | A * | 4/2000 | Hess et al. | 40/428 |
| 6,157,424 | A | 12/2000 | Eichenlaub | |
| 6,162,047 | A | 12/2000 | Hess | |
| 6,190,019 | B1 | 2/2001 | Hess | |
| 6,269,567 | B1 | 8/2001 | MacPherson et al. | |
| 6,302,555 | B1 | 10/2001 | Bristow | |
| 6,363,636 | B1 | 4/2002 | Hess et al. | |
| 6,385,881 | B1 | 5/2002 | Hess et al. | |
| 6,393,207 | B1 | 5/2002 | Martin et al. | |
| 6,413,079 | B1 | 7/2002 | Lyons et al. | |
| 6,461,011 | B1 | 10/2002 | Harrison | |
| 6,564,485 | B1 | 5/2003 | Hess | |
| 6,615,519 | B2 | 9/2003 | Hess | |
| 6,691,440 | B1 | 2/2004 | Petz et al. | |
| 6,718,665 | B2 | 4/2004 | Hess et al. | |
| 6,757,487 | B2 | 6/2004 | Martin et al. | |
| 6,799,727 | B2 | 10/2004 | Webster et al. | |
| 6,880,275 | B2 * | 4/2005 | Mix et al. | 40/428 |
| 6,919,884 | B2 | 7/2005 | Mix et al. | |
| 7,134,229 | B2 | 11/2006 | Hess et al. | |
| 7,162,820 | B2 * | 1/2007 | Hess et al. | 40/428 |
| 7,373,743 | B1 | 5/2008 | Hess | |
| 2002/0170215 | A1 | 11/2002 | Mix et al. | |
| 2003/0041491 | A1 | 3/2003 | Mix | |
| 2003/0046837 | A1 | 3/2003 | Hess | |
| 2003/0049024 | A1 | 3/2003 | Chen | |
| 2003/0072565 | A1 | 4/2003 | Ravnbo-West | |
| 2003/0110671 | A1 | 6/2003 | Hess | |
| 2003/0126775 | A1 | 7/2003 | Corry et al. | |
| 2003/0156828 | A1 | 8/2003 | Jamieson et al. | |
| 2004/0060213 | A1 | 4/2004 | Schroeter et al. | |
| 2004/0114351 | A1 | 6/2004 | Stokes et al. | |
| 2004/0264949 | A1 | 12/2004 | Deng | |
| 2005/0097793 | A1 | 5/2005 | Hess | |
| 2005/0155262 | A1 | 7/2005 | Mix et al. | |
| 2006/0101681 | A1 | 5/2006 | Hess et al. | |
| 2006/0153547 | A1 | 7/2006 | O'Neill | |
| 2006/0162198 | A1 | 7/2006 | Hess et al. | |
| 2006/0188831 | A1 | 8/2006 | Hess et al. | |
| 2006/0242870 | A1 | 11/2006 | Atemboski et al. | |
| 2007/0094903 | A1 | 5/2007 | Hess et al. | |
| 2007/0107280 | A1 | 5/2007 | Stinson et al. | |
| 2007/0224561 | A1 | 9/2007 | Hess et al. | |

FOREIGN PATENT DOCUMENTS

| | | |
|---|---|---|
| EP | 0 348 137 | 12/1989 |
| EP | 0 611 921 | 8/1994 |
| EP | 1 020 685 | 7/2000 |
| EP | 1 271 060 | 1/2003 |
| EP | 1 439 351 | 7/2004 |
| EP | 1427968 | 10/2006 |
| GB | 272836 | 6/1927 |
| GB | 322688 | 12/1929 |
| GB | 414280 | 8/1934 |
| GB | 426887 | 4/1935 |
| GB | 631594 | 11/1949 |
| GB | 957 591 | 5/1964 |
| GB | 968 568 | 9/1964 |
| GB | 975 009 | 11/1964 |
| GB | 978 364 | 12/1964 |
| GB | 978 365 | 12/1964 |
| GB | 1 088 577 | 1/1966 |
| GB | 1 024 047 | 4/1966 |
| GB | 1 097 812 | 1/1968 |
| GB | 1113209 | 5/1968 |
| GB | 1164143 | 9/1969 |
| GB | 1 186 655 | 4/1970 |
| GB | 1 266 131 | 3/1972 |
| GB | 1 443 772 | 7/1976 |
| GB | 2072832 | 10/1981 |
| GB | 2 118 096 | 10/1983 |
| GB | 2137336 | 10/1984 |
| GB | 2 151 772 | 7/1985 |
| GB | 2180927 | 4/1987 |
| GB | 2 210 969 | 6/1989 |
| GB | 2 222 000 | 2/1990 |
| GB | 2230335 | 10/1990 |
| GB | 2240171 | 7/1991 |
| GB | 2 242 737 | 10/1991 |
| GB | 2251935 | 7/1992 |
| GB | 2 261 723 | 5/1993 |
| GB | 2264555 | 9/1993 |
| GB | 2 267 563 | 12/1993 |
| GB | 2275105 | 8/1994 |
| GB | 2 276 444 | 9/1994 |
| GB | 2 288 052 | 10/1995 |
| GB | 2 290 374 | 12/1995 |
| GB | 2 290 865 | 1/1996 |
| GB | 2298073 | 8/1996 |
| GB | 2 302 172 | 1/1997 |
| GB | 2 302 730 | 1/1997 |
| GB | 2 307 132 | 5/1997 |
| GB | 2315543 | 2/1998 |
| GB | 2 321 700 | 8/1998 |
| GB | 2325733 | 12/1998 |
| GB | 2350182 | 11/2000 |
| GB | 2 372 807 | 9/2002 |
| GB | 2377752 | 1/2003 |
| GB | 2 379 009 | 2/2003 |
| GB | 2 387 901 | 10/2003 |
| GB | 2404730 | 2/2005 |
| GB | 2408322 | 5/2005 |
| GB | 2 409 323 | 6/2005 |
| GB | 2408794 | 6/2005 |
| GB | 2418984 | 4/2006 |
| GB | 2427021 | 12/2006 |
| WO | 97/41393 | 11/1997 |
| WO | 99/45326 | 9/1999 |
| WO | WO 01/57447 | 8/2001 |
| WO | WO 2004/027321 | 4/2004 |
| WO | WO 2004/109189 | 12/2004 |
| WO | WO 2005/028962 | 3/2005 |
| WO | 2005/078350 | 8/2005 |
| WO | 2006/027272 | 3/2006 |
| WO | 2006/027273 | 3/2006 |
| WO | 2006/040167 | 4/2006 |
| WO | 2008/149117 | 12/2008 |
| WO | WO 2008/151951 | 12/2008 |

* cited by examiner

FLAME SIMULATING ASSEMBLY

This application is a continuation of U.S. patent application Ser. No. 09/968,796, filed Oct. 3, 2001 now abandoned, which is incorporated herein by reference in its entirety.

FIELD OF THE INVENTION

This invention relates to flame simulating assemblies for use in electric or gas fireplaces and, in particular, a flame simulating assembly including a screen with a pattern on a front surface thereof.

BACKGROUND OF THE INVENTION

A flame simulating assembly is disclosed in U.S. Pat. No. 6,050,011 (Hess et al.) in which silk-screened dots on a screen having a partially reflective front surface are positioned in relation to corresponding dots on an inside surface of a transparent front panel to create an illusion of a brick wall. However, in order for the illusionary brick effect to be successful, the inside surface disposed in front of the screen, through which inside surface an observer can view the screen, is required. As disclosed in U.S. Pat. No. 6,050,011, the inside surface of a generally transparent front panel of the flame simulating assembly can be utilized for this purpose.

In certain circumstances, however, an electric or gas fireplace does not include a transparent front panel. For example, where space constraints limit the depth of the electric or gas fireplace, the fireplace does not include a transparent front panel. Also, the additional elements required to achieve the illusionary brick effect disclosed in U.S. Pat. No. 6,050,011 result in somewhat increased manufacturing costs.

There is therefore a need for a flame simulating assembly which simulates the appearance of firebrick in a fireplace.

SUMMARY OF THE INVENTION

In a broad aspect of the present invention, there is provided a flame simulating assembly having a simulated fuel bed, a light source, and a screen. The light source is operable to produce an image of flames appearing to be emitted from the simulated fuel bed. Also, the screen has a front surface disposed behind the simulated fuel bed for transmitting the image of flames through the front surface. The screen also includes a pattern for simulating the appearance of firebrick to a viewer of the image of flames.

BRIEF DESCRIPTION OF THE DRAWINGS

The invention will be better understood with reference to the drawings, in which.

BRIEF DESCRIPTION OF THE PREFERRED EMBODIMENT(S)

Figure 1:
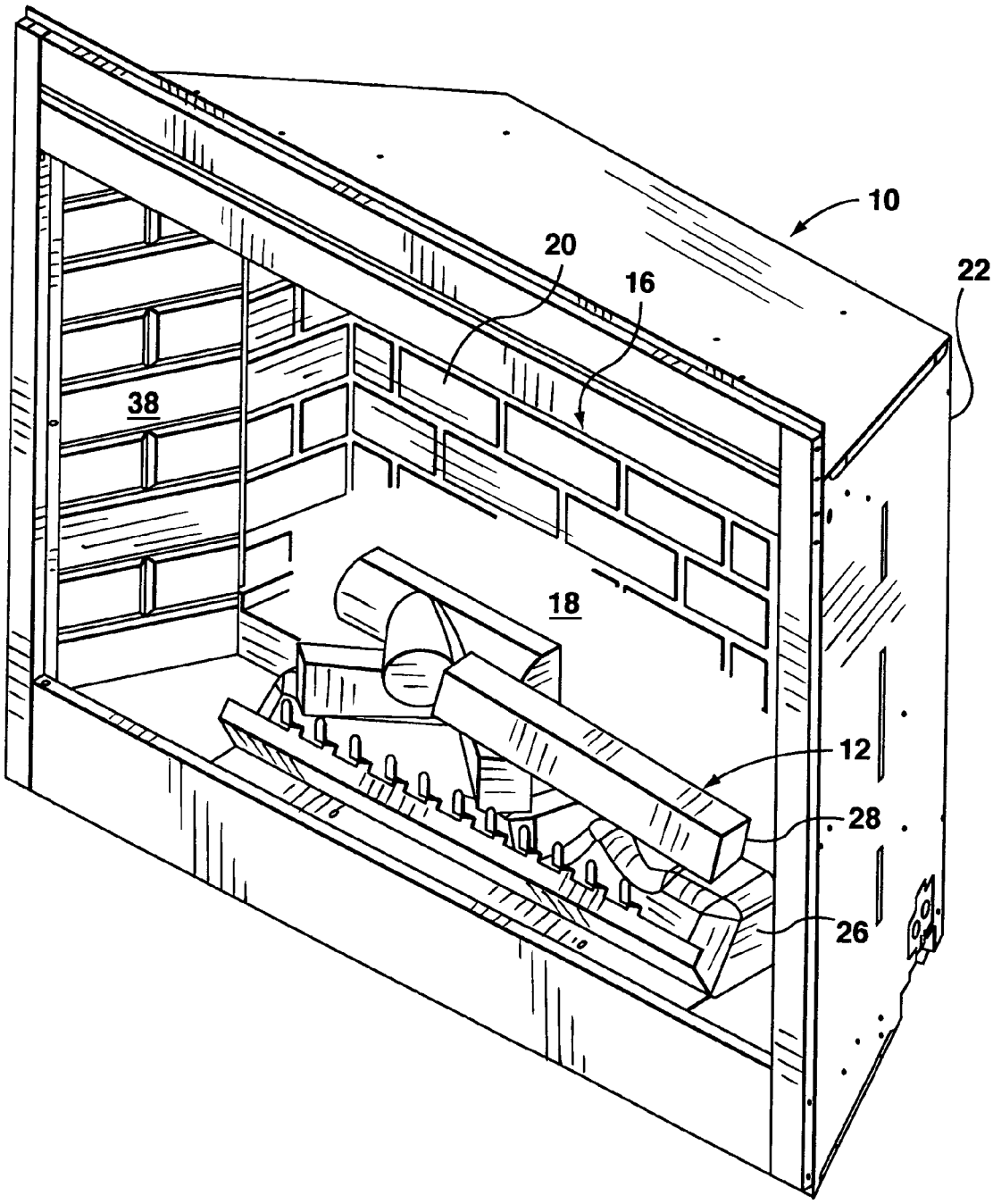
FIG. 1 is an isometric view of the preferred embodiment of a flame simulating assembly.
Figure 2:
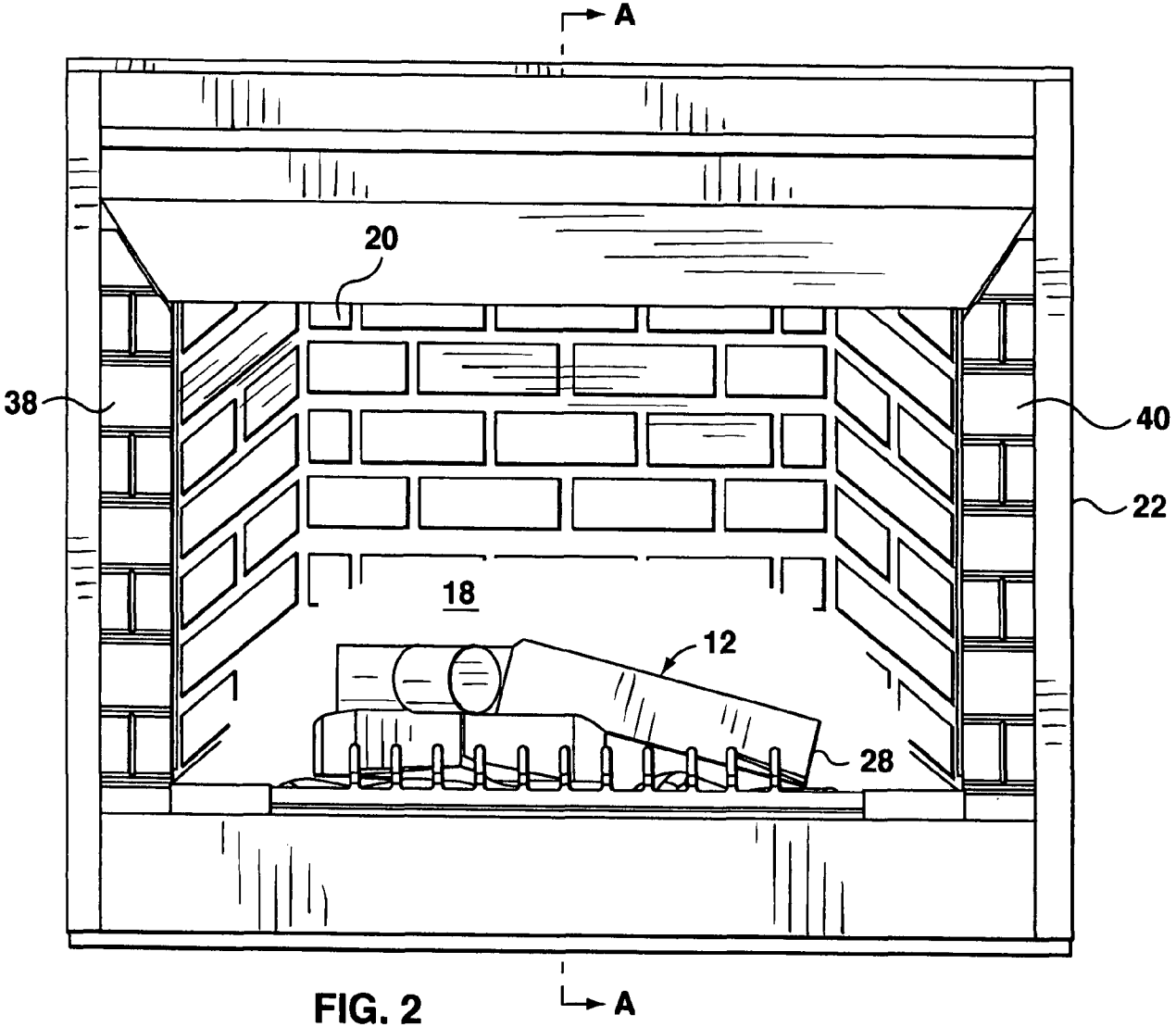
FIG. 2 is a front view of the flame simulating assembly of FIG. 1.
Figure 3:
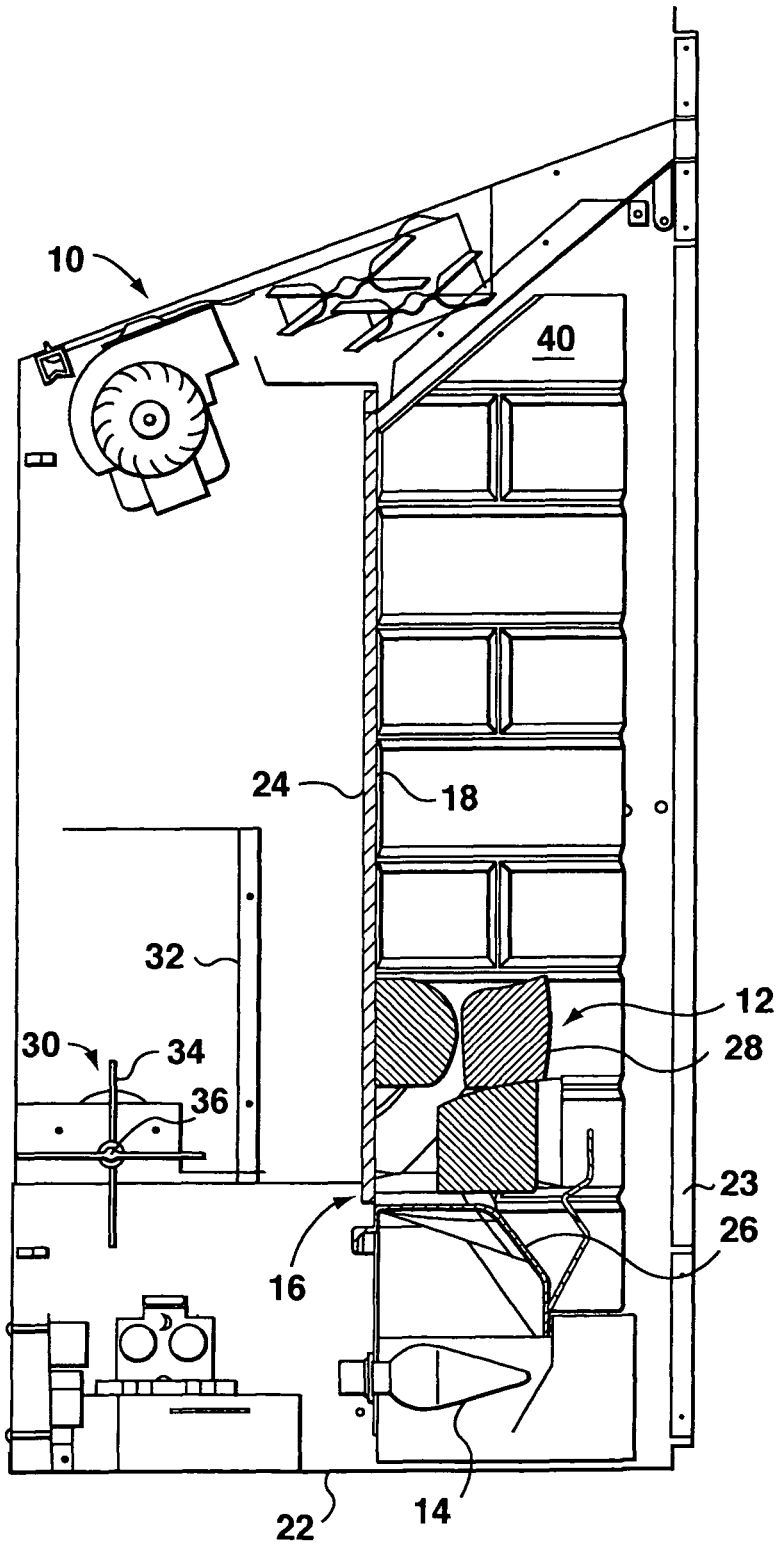
FIG. 3 is a section along line A-A in FIG. 2.

Reference is first made to FIG. 1 to describe a preferred embodiment of a flame simulating assembly indicated generally by the numeral 10 in accordance with the invention. As can be seen in FIGS. 1-3, the flame simulating assembly 10 includes a simulated fuel bed 12, a light source 14, and a screen 16. In the preferred embodiment, the light source 14 is operable to produce an image of flames appearing to be emitted from the simulated fuel bed 12. The screen 16 has a front surface 18 disposed behind the simulated fuel bed 12 for transmitting the image of flames through the front surface 18. In the preferred embodiment, the screen 16 includes a pattern 20 for simulating the appearance of firebrick to a viewer (not shown) of the image of flames.

As can be seen in FIGS. 1-3, the flame simulating assembly 10 includes a housing 22 to which the components comprising the flame simulating assembly 10 are directly or indirectly attached in any suitable manner. The preferred embodiment of the flame simulating assembly 10 could include a transparent panel in slot 23 positioned at the front of the housing 22.

Preferably, the front surface 18 is partially reflective, for reflecting an image of the simulated fuel bed 12. In addition, and as disclosed in U.S. Pat. Nos. 4,965,707, 5,642,580, and 6,050,011, the screen 16 includes a back surface or member 24 disposed behind the partially reflective front surface 18 for diffusing and transmitting light through the partially reflective front surface 18. Preferably, the pattern 20 is positioned in front of the back surface 24.

As disclosed in U.S. Pat. No. 4,965,707, the partially reflective front surface 18 can be constructed of glass or any other suitable material, such as acrylic or perspex, which is preferably lightly silvered. The back surface 24 may comprise a rear surface of the sheet of material which includes the partially reflective front surface, or a back member comprising, for example, a sheet of glass or any other suitable material which has been etched, abraded, frosted or otherwise created or treated so that it diffuses light transmitted through it.

Preferably, the pattern 20 is formed on the front surface 18. The pattern 20 can be painted or imprinted on the front surface 18 by any suitable method. For example, the pattern 20 could be screened, typographed, lithographed, engraved, or otherwise formed on the front surface 18. The pattern 20 could be formed using ink or paint or the like, and in color or, alternatively, in black and white. Preferably, the pattern 20 is formed on the front surface 18 with black and grey ink applied using silk screening. The pattern 20 is preferably formed to simulate the appearance of a wall of firebrick, and drawn or printed so that the pattern 20 gives the illusion of depth.

As indicated, the pattern 20 is formed to simulate the appearance of firebrick, a highly heat-resistant brick made from fire clay and used to line furnaces, chimneys, and fireplaces. Alternatively, the pattern 20 could be formed to simulate the appearance of any other suitable object or objects.

The simulated fuel bed 12 can be made of any suitable materials. Preferably, the simulated fuel bed 12 comprises a simulated ember bed 26 and a plurality of simulated fuel elements 28. It is preferred that the simulated ember bed 26 is formed to receive the simulated fuel elements 28, as described in Canadian Patent No. 2,310,362. FIGS. 1-3 show a plurality of simulated fuel elements 28 which are simulated logs of wood. Alternatively, the simulated fuel elements 28 could be formed and shaped to resemble lumps of coal (not shown).

As can be seen in FIG. 3, the preferred embodiment of the flame simulating assembly 10 also includes a flicker element 30 and a flame effect element 32. The flicker element 30 is positioned in a path of light transmitted from the light source 14 to the back surface 24, for causing the light to flicker, to produce an image of flames. Preferably, and as disclosed in U.S. Pat. No. 5,642,580, the flicker element 30 comprises a plurality of strips 34 of substantially reflective material disposed around an axis 36 and extending radially outwardly from the axis 36. When the flame simulating assembly 10 is operating, the flicker element 30 is rotated about the axis 36 by any suitable means, such as a rotor (not shown).

In the preferred embodiment, the flame effect element 32 is preferably made of sheet metal or any other suitable material, as disclosed in U.S. Pat. No. 6,047,489. The flame effect element 32 is positioned in a path of flickering light from the light source 14 which has been reflected by the flicker element 30, to configure the flickering light. The flame effect element 32 configures the flickering light to produce an image of flames. Where the flame effect element 32 comprises a piece of sheet metal, a flame pattern is cut into the piece to provide one or more openings which configure the flickering light into an image of flames, so that the image of flames appears through the front surface 18. Other suitable arrangements could be made, for example, the flame effect element 32 could alternatively comprise a reflective surface (not shown) shaped and positioned so as to configure the flickering light into an image of flames.

As can be seen in FIGS. 1-3, the preferred embodiment of the flame simulating assembly 10 also includes two panels 38, 40. FIG. 2 shows panels 38, 40 disposed in substantially vertical positions adjacent to vertical sides 41 of the front surface 18 between the screen 16 and the housing 22. Each of the panels 38, 40 is shaped and colored to simulate the appearance of the firebrick simulated by the pattern 20. Preferably, a sidewall pattern 42 is included on the panels 38, 40 which is so positioned that, when the panels 38, 40 are in place, the sidewall pattern 42 is aligned with the pattern 20, thereby further providing an illusion of depth.

In use, in the preferred embodiment of the flame simulating assembly 10, light from the light source 14 is transmitted through the front surface 18 so that an image of flames appears through the front surface 18. The image of flames appears to be emitted from the simulated fuel bed 12. The pattern 20 provides an image of firebrick on, or transmitted through, the front surface 18, thereby achieving an improved simulation of a wood or coal fire in a real fireplace. The sidewall pattern 42 on the panels 38, 40 further enhances the overall simulation effect.

Figure 4:
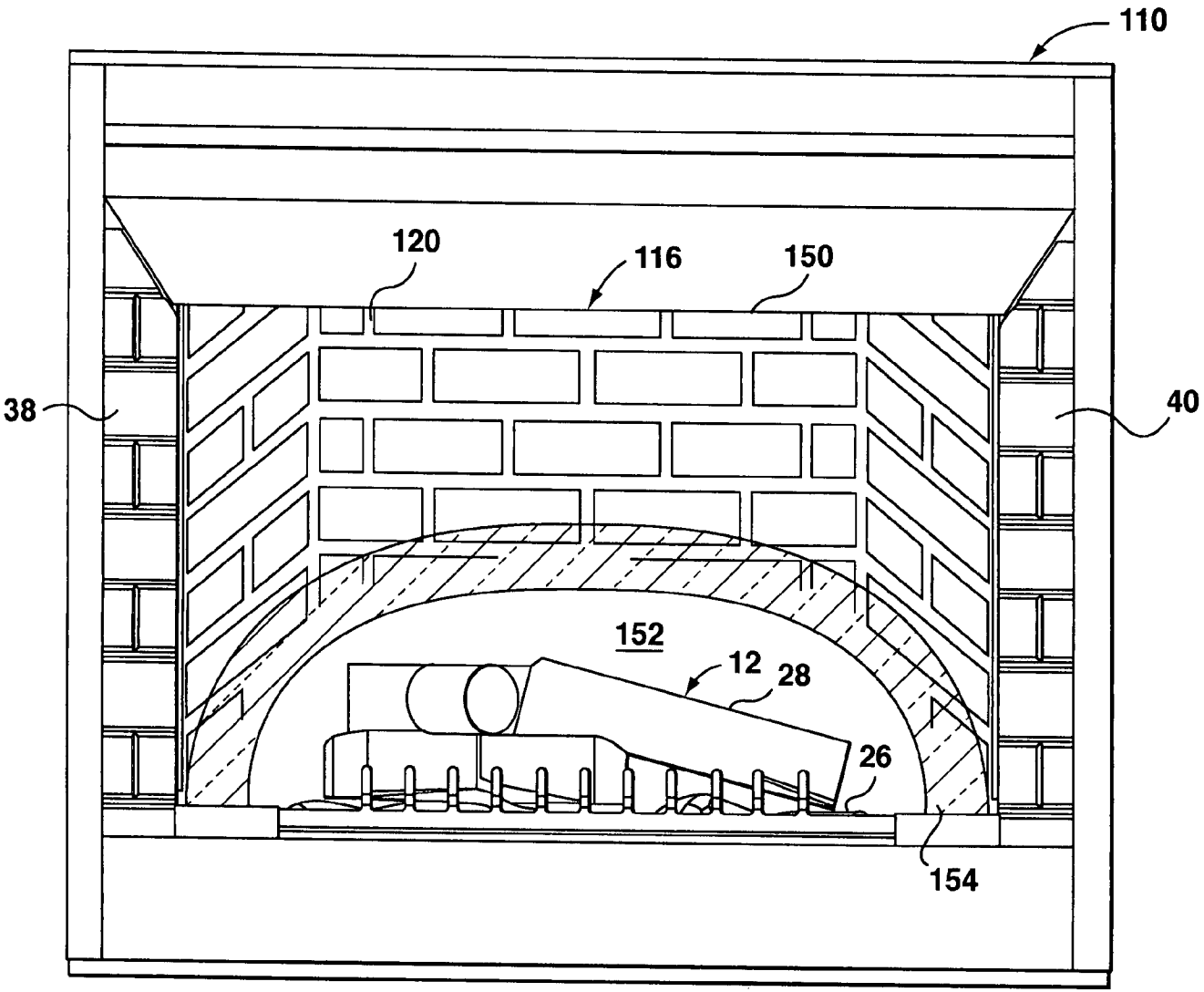
FIG. 4 is a front view of another embodiment of the flame simulating assembly.

Another embodiment of the flame simulating assembly 110 is shown in FIG. 4. In FIG. 4, elements are numbered so as to correspond with like elements shown in FIGS. 1-3.

The flame simulating assembly 110 includes a screen 116 which includes a non-reflective matte region 150, a generally reflective region 152, and a transition region 154. As disclosed in U.S. Pat. No. 6,269,567, the generally reflective region 152 is positioned adjacent to the simulated fuel bed 12, and at least partially reflects the simulated fuel bed 12. The non-reflective matte region 150 is positioned distal to the simulated fuel bed 12, and transmits the image of flames. The transition region 154 is positioned between the non-reflective matte region 150 and the generally reflective region 152.

In the flame simulating assembly 110, a pattern 120 is preferably positioned substantially in the non-reflective matte region 150, and also extending into the transition region 154. Preferably, and as shown in FIG. 4, the pattern 120 simulates the appearance of firebrick. The simulation effect achieved with the pattern 120 is somewhat enhanced due to the pattern 120 being used in combination with the non-reflective matte region 150 and the transition region 154, as shown in FIG. 4, and as described. Alternatively, the pattern 120 could simulate the appearance of any suitable object or objects.

The above-described embodiments of the present invention are intended to be examples only. Alterations, modifications and variations may be effected to the particular embodiments by those skilled in the art without departing from the scope of the invention, which is defined solely by the claims appended hereto.

We claim:

1. A flame simulating assembly for providing an image of flames, the flame simulating assembly comprising:

a simulated fuel bed;

a light source for providing light to produce the image of flames;

a flicker element for causing light from the light source to flicker, to produce the image of flames;

a screen comprising a front surface disposed behind the simulated fuel bed and positioned in a path of flickering light from the light source, for transmitting the image of flames through the front surface; and the screen additionally comprising a pattern imprinted on the front surface through which the image of flames is transmittable for simulating a firebrick wall such that the pattern gives the illusion of depth, the simulated firebrick wall appearing to be spaced apart from and behind the image of flames transmitted therethrough.

2. A flame simulating assembly according to claim 1 in which the front surface is partially reflective for reflecting an image of the simulated fuel bed, the screen additionally comprising a back surface disposed behind the partially reflective front surface for diffusing and transmitting light from the light source through the front surface.

3. A flame simulating assembly according to claim 2 in which the partially reflective front surface has a non-reflective matte region, the non-reflective matte region being disposed distal from the simulated fuel bed, and the portion of the front surface not covered by the non-reflective matte region comprises a generally reflective region, such that the simulated fuel bed is substantially the only object reflected in the front surface.

4. A flame simulating assembly according to claim 3 wherein the front surface further comprises a transition region which is partially reflective and partially non-reflective, the transition region being disposed between the non-reflective matte region and the reflective region.

5. A flame simulating assembly for providing an image of flames, the flame simulating assembly comprising:

a simulated fuel bed;

a light source for providing light to produce the image of flames;

a flicker element for causing light from the light source to flicker, to produce the image of flames;

a screen comprising a front surface disposed behind the simulated fuel bed and positioned in a path of flickering light from the light source, for transmitting the images of flames through the front surface; and the screen additionally comprising a pattern imprinted thereon through which the image of flames is transmittable for simulating a firebrick wall, the pattern providing an illusion of depth such that the simulated firebrick wall appears to be spaced apart from and behind the image of flames transmitted therethrough.

6. A flame simulating assembly according to claim 5 in which the front surface is partially reflective for reflecting an image of the simulated fuel bed, the screen additionally comprising a back surface disposed behind the partially reflective front surface for diffusing and transmitting light from the light source through the front surface.

7. A flame simulating assembly comprising:

a simulated fuel bed;

a light source;

a screen positioned in a path of light from the light source and adapted to provide an image of flames transmitted through the screen; and the screen comprising a pattern imprinted thereon through which the image of flames is transmittable for simulating a firebrick wall, the pattern being drawn to provide an illusion that the firebrick wall is spaced apart from and behind the image of flames transmitted therethrough.

8. A flame simulating assembly according to claim 7 in which the front surface is partially reflective for reflecting an image of the simulated fuel bed, the screen additionally comprising a back surface disposed behind the partially reflective front surface for diffusing and transmitting light from the light source through the front surface.

9. A flame simulating assembly comprising:

a simulated fuel bed;

a light source;

a screen comprising a partially reflective front surface disposed behind the simulated fuel bed for reflecting and transmitting light, and a diffusing back surface disposed behind the partially reflective front surface for diffusing and transmitting light;

a flicker element positioned in a path of light transmitted from the light source to the diffusing back surface, to produce an image of flames;

light from the light source being transmittable through the front surface to provide the image of flames;

the partially reflective front surface comprising a non-reflective matte region, the non-reflective matte region being disposed distal from the simulated fuel bed, and the portion of the front surface not covered by the non-reflective matte region comprising a generally reflective region, such that the simulated fuel bed is substantially the only object reflected in the front surface; and the screen additionally comprising a pattern printed on the front surface of the screen through which the image of flames is transmittable, for simulating a firebrick wall spaced apart from and behind the image of flames transmitted therethrough.

10. A flame simulating assembly according to claim 9 wherein the front surface further comprises a transition region which is partially reflective and partially non-reflective, the transition region being disposed between the non-reflective matte region and the reflective region.

11. A flame simulating assembly according to claim 10 in which the pattern is positioned in the non-reflective matte region and extends into the transition region and at least partly into the reflective region.

* * * * *